United States Patent [19]

Edelhaeuser et al.

[11] Patent Number: 5,063,366

[45] Date of Patent: Nov. 5, 1991

[54] ELECTROMAGNETIC RELAY

[75] Inventors: Erhard Edelhaeuser, Ansbach; Hans-Dieter Schmid; Ludwig Speckner, both of Nuremberg; Karl Wutz, Neumarkt; Horst Steffen, Schwarzenbruck, all of Fed. Rep. of Germany

[73] Assignee: Robert Bosch GmbH, Stuttgart, Fed. Rep. of Germany

[21] Appl. No.: 529,907

[22] Filed: May 29, 1990

[30] Foreign Application Priority Data

Aug. 5, 1989 [DE] Fed. Rep. of Germany ... 8909467[U]

[51] Int. Cl.[5] ..... H01H 67/02; H01F 7/08

[52] U.S. Cl. ..... 335/271; 335/128; 335/275; 335/276

[58] Field of Search ..... 335/271, 275, 247, 249, 335/128, 270, 274, 277, 276

[56] References Cited

U.S. PATENT DOCUMENTS 4,342,017 7/1982 Rautiola ..... 335/128

FOREIGN PATENT DOCUMENTS 1257967 1/1968 Fed. Rep. of Germany ..... 335/274

2027996 2/1980 United Kingdom ..... 335/128

*Primary Examiner*—Leo P. Picard

*Assistant Examiner*—Ramon M. Barrera

*Attorney, Agent, or Firm*—Michael J. Striker

[57] ABSTRACT

Disclosed is an electromagnetic relay whose armature assembly is protected against jarring impacts. The armature assembly is tiltably supported in a recess stamped out in an end portion of the magnetic yoke of the relay. Lateral inner walls of the recess are formed at their free ends with shoulders for engaging a flat biasing spring of the armature assembly. At least one lateral portion of the magnetic yoke delimiting the recess is formed with a constricted region, for example with a cutout in a corner between an inner wall and the bottom wall of the recess. The constriction permits the bending of the lateral projection into an open condition in which the corresponding shoulder is out of the way during the insertion of the armature assembly into the recess. Upon the insertion, the lateral projection is bent toward the armature until the corresponding shoulder overlaps the armature edge.

1 Claim, 1 Drawing Sheet

ELECTROMAGNETIC RELAY

BACKGROUND OF THE INVENTION

The present invention relates to an electromagnetic relay having a core, a relay winding on the core, an L-shaped magnetic yoke connected at one end thereof to the core, and an armature hinged in a recess at the other end of the magnetic yoke, the armature being attached to a leaf spring whose free end supports a switching contact cooperating with a fixed contact and the other end of the leaf spring engaging shoulders formed on the lateral projections delimiting the recess whereby the shoulders protect the armature against jarring impacts.

In hinged armature relays of this kind known from the DE-OS 36 40 326 a so-called jarring impact protection of the hinged armature is known wherein the region of support of the armature in a recess at the end of the magnetic yoke, shoulders are provided which overlap two opposite sides of the armature. The shoulders prevent an overload of the biasing spring of the hinged armature above its elasticity limit in the case of a fall or an impact against the relay which might weaken contact pressure of the spring. A disadvantage of this known solution is the fact that it can be used only with such constructions of the relay at which the armature is insertable into the recess of the magnetic yoke from front or from back. In the constructions of relays where the armature must be inserted through the open top of the recess in the magnetic yoke, the shoulders form an obstacle.

SUMMARY OF THE INVENTION

It is therefore an object of the present invention to overcome the aforementioned disadvantage.

More particularly, it is an object of the invention to provide a protection of the relay against jarring impacts in such a manner that the armature can be inserted into the bearing recess of the magnetic yoke also from the top side of the recess.

In keeping with this object and others which will become apparent hereafter, one feature of the invention resides in an electromagnetic relay of the above described kind in the provision of a constricted region in at least one lateral wall delimiting the recess and supporting the shoulders such that the one projection can be bent between an open position at which a corresponding shoulder is disengaged from the armature and a closed position in which the shoulder engages the armature.

The solution according to the invention has the advantage that in the open position of the bent projection the corresponding shoulder does not interfere with the insertion of the armature in the recess of the magnetic yoke whereby one side of the armature can be brought into engagement with the shoulder at the opposite lateral projection whereupon the first mentioned lateral projection is bent back into its closed position by applying lateral pressure until the corresponding shoulder engages the assigned side of the armature.

In the preferred embodiment of this invention, a corner region between one of the projections and the bottom surface of the recess is stamped out with a trough-shaped cutout which constricts the cross-section of the projection to define its point of bending and to prevent clamping of the armature in the recess in the closed position of the bendable projection.

In order to delimit lateral play of the armature it is of advantage when the inner walls of the lateral projections below the shoulders have respectively a boundary surface portion which provide lateral guidance for the armature along opposite sides of the recess. To avoid clamping of the armature by the boundary surface portions, the latter has preferably an arcuate configuration.

The novel features which are considered as characteristic for the invention are set forth in particular in the appended claims. The invention itself, however, both as to its construction and its method of operation, together with additional objects and advantages thereof, will be best understood from the following description of a specific embodiment when read in connection with the accompanying drawing.

DESCRIPTION OF THE PREFERRED EMBODIMENT

Figure 1:
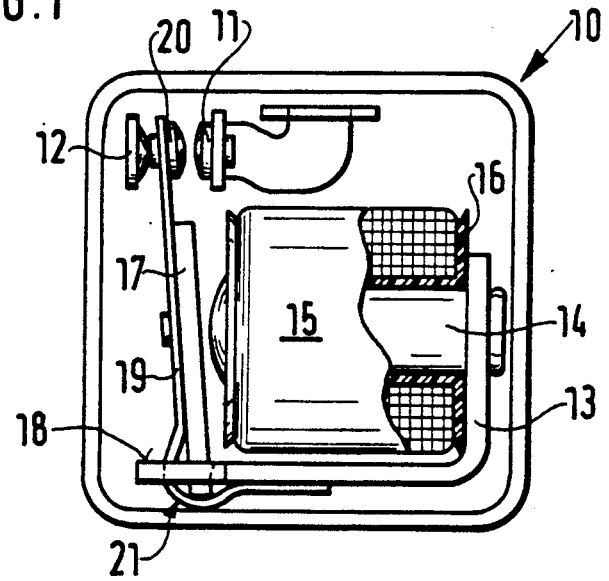
FIG. 1 shows on an enlarged scale a plan view of an electromagnetic relay of the invention.

The electromagnetic relay illustrated in FIG. 1 includes a base plate 10 of plastics upon which a make contact 11 and a rest contact 12 as well as an L-shaped magnetic yoke 13 are mounted. The magnetic yoke 13 supports on its shorter leg a coil core 14 on which relay winding 15 wound on a coil form 16, is supported. Opposite the free end of the coil core 14 a flap armature 17 is arranged. The armature is tiltably supported in a recess 18 at the free end of the magnetic yoke 13 by means of a leaf spring 19 whose intermediate portion is fastened to the armature and whose free front end is provided with a switching contact 20 located between the fixed contacts 11 and 12. The rear end portion of the flat leaf spring 19 is arched to circumvent the hinge support area 21 of the flat armature 17 and is secured to the other leg of the magnetic yoke 13 such as to bias the armature 17 into its rest position at which the switching contact 20 abuts against the rest contact 12 at a predetermined contact pressure.

Figure 2:
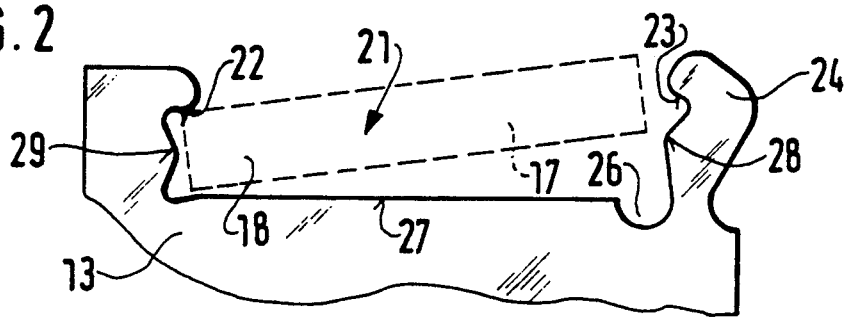
FIG. 2 shows on an enlarged scale a rear side of a recess in the magnetic yoke of the relay of FIG. 1 prior to the insertion of the armature assembly.
Figure 3:
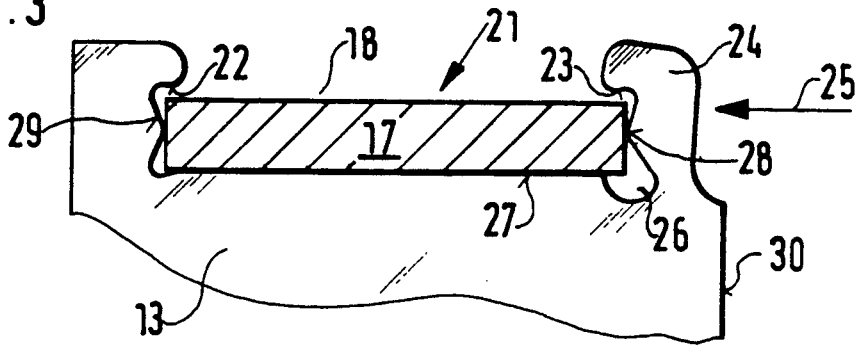
FIG. 3 shows the recess of FIG. 2 after the insertion of the armature assembly.

FIGS. 2 and 3 show the hinge support area 21 of the armature 17 produced by stamping out a recess 18 in the end portion of the magnetic yoke 13. A lateral projection at the left side of the recess 18 is formed at its top with a transverse shoulder 22 which serves as a protection of the armature 17 against jarring impacts and, according to FIG. 3, overlaps by a small distance a lateral edge of the armature plate. A corresponding shoulder 23 is formed on the lateral projection 24 delimiting the right side of the recess 18. Initially the stamped out configuration of the lateral projection 24 corresponds to an open condition of the recess 18 illustrated in FIG. 2. In the open condition the open top of the recess 18 has a clearance sufficient for permitting the insertion of the armature 21, shown in dashed lines, from above until its left hand edge is below the shoulder and its bottom rests on the bearing, surface 27. After the insertion of the flap armature 17 into the recess 18, the lateral projection 24 is subject to a lateral pressure in the direction of arrow 25 in FIG. 3 to bend inwardly toward the right side of the armature 17 until the corresponding shoulder 23 overlaps the righthand edge of the armature. The upper side of the armature has a certain play with respect to the shoulders 22 and 23. To facilitate the bending of the lateral projection 24 from its open condition (FIG. 2) into its closed condition (FIG. 3) a trough-shaped cutout 26 is formed in the corner area between the bearing surface 27 and the projection 24 to create a constriction in the projection which determines the area of bending. In addition, the inner wall of each lateral projection below the shoulders 22 and 23 is formed with a boundary surface portion 29 and 28 for guiding the opposite lateral sides of the armature 17 within the recess 18. To avoid a lateral clamping of the armature in the recess, the boundary surface portions 28 and 29 have an arcuate configuration with rounded edges. The lateral play between the armature and the boundary surface portions can be adjusted during the bending of the projection 24 in the direction of arrow 25 by using a lateral edge 30 of the magnetic yoke 13 as an abutment for a non-illustrated bending tool.

What is claimed as new and desired to be protected by Letters Patent is set forth in the appended claims:

1. An electromagnetic relay comprising core, a relay winding on the core, an L-shaped magnetic yoke connected at one end thereof to the core, an armature assembly including an armature plate attached to a flat biasing spring, the armature assembly being hinged in a recessed support stamped out at the other end of the yoke; the recessed support being delimited by a bottom surface and two lateral projections extending from the bottom surface, each lateral projection having at its free end a shoulder engaging the armature assembly to prevent jarring impacts on the spring; a switching contact arranged on a free end of the spring; at least one fixed contact arranged opposite the switching contact; and at least one of the two projections having constricted region for permitting the bending of the projection between an open condition at which a corresponding shoulder is remote from the armature assembly, and a closed condition at which the shoulder overlaps the armature assembly, the constricted region being a trough-shaped cutout provided in a corner between one of the projections and the bottom surface of the recess, the respective lateral projections having inner walls formed with boundary surface portions for guiding opposite lateral sides of the armature assembly within the recess, the boundary surface portions having an arcuate configuration with rounded edges.

* * * * *